US010773301B2

(12) United States Patent
Takahashi

(10) Patent No.: US 10,773,301 B2
(45) Date of Patent: Sep. 15, 2020

(54) MOLTEN METAL HOLDING CONTAINER

(71) Applicant: TOYOTA JIDOSHA KABUSHIKI KAISHA, Toyota-shi, Aichi-ken (JP)

(72) Inventor: Takaaki Takahashi, Toki (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 128 days.

(21) Appl. No.: 16/037,213

(22) Filed: Jul. 17, 2018

(65) Prior Publication Data

US 2019/0060991 A1 Feb. 28, 2019

(30) Foreign Application Priority Data

Aug. 30, 2017 (JP) ..... 2017-165473

(51) Int. Cl.
*B22D 41/01* (2006.01)
*B22D 41/00* (2006.01)

(52) U.S. Cl.
CPC ..... *B22D 41/01* (2013.01); *B22D 41/00* (2013.01)

(58) Field of Classification Search
CPC ..... B22D 41/00; B22D 41/01
USPC ..... 222/593; 220/590.01, 592.27, 4.12
See application file for complete search history.

(56) References Cited

U.S. PATENT DOCUMENTS 1,517,978 A * 12/1924 Giese ..... B65D 81/3841 220/62.18
1,651,655 A * 12/1927 Fairfax ..... A47J 41/022 220/592.27
1,672,728 A 6/1928 Otis
3,097,084 A * 7/1963 Putman ..... F17C 3/08 62/45.1
3,134,237 A * 5/1964 Canty ..... F17C 3/02 62/48.3
4,982,871 A * 1/1991 Kiecker ..... B22D 41/01 220/592.01
2002/0130449 A1 9/2002 Krause et al.
2007/0295684 A1* 12/2007 Fujii ..... A47J 41/026 215/12.1
2018/0224053 A1* 8/2018 Yamashita ..... F27D 3/0025
2019/0062036 A1* 2/2019 Yamashita ..... A47J 41/028

FOREIGN PATENT DOCUMENTS

CN 102151820 A 8/2011
JP 2015-174091 A 10/2015
JP 2015-196171 A 11/2015
SU 624719 A1 9/1978

* cited by examiner

*Primary Examiner* — Scott R Kastler
*Assistant Examiner* — Michael Aboagye
(74) *Attorney, Agent, or Firm* — Sughrue Mion, PLLC

(57) ABSTRACT

A molten metal holding container 1 includes an extraction outer pipe 12, an extraction inner pipe 13 and a load receiving part 7 including a first protrusion 7*a* protruding from an outer circumference of the inner pipe 3 in the horizontal direction and a second protrusion 7*b* protruding from an inner circumference of the outer pipe 2 in the horizontal direction so as to be opposed to the first protrusion 7*a* in a vertical direction, the second protrusion 7*b* being configured to receive a load of the inner pipe 3 through the first protrusion 7*a*, in which a vertical position of the load receiving part 7 coincides with a vertical position of a central axis of the extraction inner pipe 13.

4 Claims, 5 Drawing Sheets

PRIOR ART

MOLTEN METAL HOLDING CONTAINER

CROSS REFERENCE TO RELATED APPLICATIONS

This application is based upon and claims the benefit of priority from Japanese patent application No. 2017-165473, filed on Aug. 30, 2017, the disclosure of which is incorporated herein in its entirety by reference.

BACKGROUND

The present disclosure relates to a molten metal holding container to which a double insulating wall structure is applied.

A molten metal holding container that contains molten metal in a heat retaining state has been known. Japanese Unexamined Patent Application Publication No. 2015-196171 discloses a molten metal holding container in which an inner wall of a container for containing molten metal is formed by at least two types of segment members having different functions.

SUMMARY

The present inventors have found the following problem. A molten metal holding container having a double wall structure composed of an outer wall and an inner wall, and having an extraction inner pipe for extracting molten metal contained in a containing space inside the inner wall to the outside has been developed. FIG. 5 is a schematic diagram for explaining an example of a molten metal holding container to which a problem to be solved by the present disclosure is related. In FIG. 5, an upper part shows a state of a molten metal holding container 701 before molten metal W is put into a containing space 717 (a molten metal non-containing state) and a lower part shows a state in which the molten metal W is put in the containing space 717 (a molten metal containing state). Note that a right-handed xyz-coordinate system shown in FIG. 5 is illustrated for the sake of convenience for explaining a positional relation among components. As shown in FIG. 5, the molten metal holding container 701 includes an outer pipe 702 serving as an outer wall, an inner pipe 703 serving as an inner wall, and an extraction inner pipe 713.

The inner pipe 703 is disposed inside the outer pipe 702. A space inside the inner pipe 703 serves as a containing space 717 for containing molten metal W. An immersion heater 9 for maintaining the molten metal W at a heated temperature is disposed in the containing space 717. A depressurized first sealed space 708 is formed between the outer pipe 702 and the inner pipe 703. In this way, it is possible to prevent heat from being transferred from the inner pipe 703 to the outer pipe 702. An extraction outer pipe 712 extends from the outer pipe 702 in a horizontal direction and its internal space is connected to a space inside the outer pipe 702. The extraction inner pipe 713 is disposed inside the extraction outer pipe 712. The extraction inner pipe 713 extends from the inner pipe 703 in the horizontal direction and its internal space is connected to a space inside the inner pipe 703. The extraction inner pipe 713 is provided to enable the molten metal W to be extracted from the inside of the inner pipe 703 to a casting machine 14. A depressurized second sealed space 718 is formed between the extraction outer pipe 712 and the extraction inner pipe 713, and is connected to the first sealed space 708.

The outer and inner pipes 702 and 703 are made of a metallic material such as stainless steel. Therefore, when a high-temperature molten metal W is put into the containing space 717, the inner pipe 703 thermally expands in an axial direction (indicated by an arrow A10) and a radial direction (indicated by an arrow B10). When the high-temperature molten metal W is put in the containing space 717, the outer pipe 702 hardly thermally expands. Therefore, the position of the upper end of the inner pipe 703 in the vertical direction, which is connected to an annular part 702*a* at the upper end of the outer pipe 702 in the vertical direction, hardly moves and is substantially fixed in the vertical direction. Therefore, when the high-temperature molten metal W is put into the containing space 717, the position of the upper end of the inner pipe 703 in the vertical direction becomes the center C2 of the thermal expansion and the part of the inner pipe 703 that is located below this thermal expansion center C2 in the vertical direction thermally expands downward (in a direction indicated by the arrow A10). When the inner pipe 703 thermally expands in this manner, the position of a part of the extraction inner pipe 713 at which the extraction inner pipe 713 is connected to the inner pipe 703 moves downward in the vertical direction. Therefore, a stress is exerted on the extraction inner pipe 713, which could cause the extraction inner pipe 713 to be broken.

The present disclosure has been made in view of the above-described background and an object thereof is to provide a molten metal holding container capable of, when molten metal is contained therein, preventing an extraction inner pipe from being broken due to a stress which would otherwise be exerted on the extraction inner pipe because of thermal expansion of an inner wall.

A first exemplary aspect is a molten metal holding container including an outer wall having a bottom at a lower end in a vertical direction, and an inner wall having a bottom at a lower end in the vertical direction, the inner wall being disposed inside the outer wall, in which a depressurized first sealed space is formed between the outer wall and the inner wall, and the molten metal holding container is configured to contain molten metal inside the inner wall, and in which the molten metal holding container further includes: an extraction outer pipe extending from the outer wall in a horizontal direction, a space inside the extraction outer pipe being connected to a space inside the outer wall; an extraction inner pipe for extracting the molten metal from inside the inner wall, the extraction inner pipe being disposed inside the extraction outer pipe and extending from the inner wall in the horizontal direction, a space inside the extraction inner pipe being connected to a space inside the inner wall; and a load receiving part including a first protrusion protruding from an outer circumference of the inner wall in the horizontal direction and a second protrusion protruding from an inner circumference of the outer wall in the horizontal direction so as to be opposed to the first protrusion in a vertical direction, the second protrusion being configured to receive a load of the inner wall through the first protrusion, a depressurized second sealed space is formed between the extraction outer pipe and the extraction inner pipe, the second sealed spaced being connected to the first sealed space, and a vertical position of a vertically lower-side surface of the first protrusion supported by the outer wall through the second protrusion coincides with a vertical position of a central axis of the extraction inner pipe.

When high-temperature molten metal is put into the containing space, the inner wall thermally expands in an axial direction and in a radial direction. The second protrusion protruding from the inner circumference of the outer wall in the horizontal direction receives the load of the inner wall through the first protrusion protruding from the outer circumference of the inner wall in the horizontal direction. When the high-temperature molten metal is put in the containing space, the outer wall hardly thermally expands. Therefore, the vertical position of the first protrusion supported by the second protrusion hardly moves and is substantially fixed. Therefore, when the high-temperature molten metal is put into the containing space, the position of the second protrusion in the vertical direction becomes the center of the thermal expansion. Further, the part of the inner wall that is located above the thermal expansion center in the vertical direction thermally expands upward and the part of the inner wall that is located below the thermal expansion center in the vertical direction thermally expands downward. Since the vertical position of the vertically lower-side surface of the first protrusion supported by the outer wall through the second protrusion coincides with the vertical position of the central axis of the extraction inner pipe, the position of the extraction inner pipe does not move in the vertical direction. Therefore, it is possible to, when molten metal is contained in the molten metal holding container, prevent the extraction inner pipe from being broken due to a stress which would otherwise be exerted on the extraction inner pipe because of thermal expansion of the inner wall.

Further, an insertion member formed of a material having a thermal conductivity lower than that of the outer wall and the inner wall may be inserted between the first and second protrusions. In this way, it is possible to prevent heat from being transferred from the inner wall to the outer wall through the load receiving part more effectively.

Further, an upper end of the outer wall in the vertical direction and an upper end of the inner wall in the vertical direction may be connected to each other through a bellows. In this way, when molten metal is put into the containing space, vertically upward expansion of the part of the inner wall that is located above the thermal expansion center in the vertical direction is absorbed by the bellows as the bellows contracts. In this way, it is possible to prevent the inner wall from being warped due to the thermal expansion.

Further, the molten metal holding container may include a bellows connection part in a middle of a part of the extraction inner pipe that is located in the second sealed space. When molten metal is put into the containing space, the inner wall thermally expands in the radial direction and, as a result, the position of the extraction inner pipe in the horizontal direction moves. Since the bellows connection part is provided in a middle of the part of the extraction inner pipe located in the second sealed space, it is possible to absorb the movement of the position of the extraction inner pipe in the horizontal direction. As a result, it is possible to prevent the extraction inner pipe from being warped due to the thermal expansion of the inner wall.

According to the present disclosure, it is possible to, when molten metal is contained in the molten metal holding container, prevent the extraction inner pipe from being broken due to a stress which would otherwise be exerted on the extraction inner pipe because of thermal expansion of the inner wall.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

A first embodiment according to the present disclosure is described below with reference to the drawings. Note that right-handed xyz-coordinate systems shown in the figures are illustrated for simplifying an explanation of positional relations among components.

Firstly, a configuration of a molten metal holding container 1 according to this embodiment is described.

Figure 1:
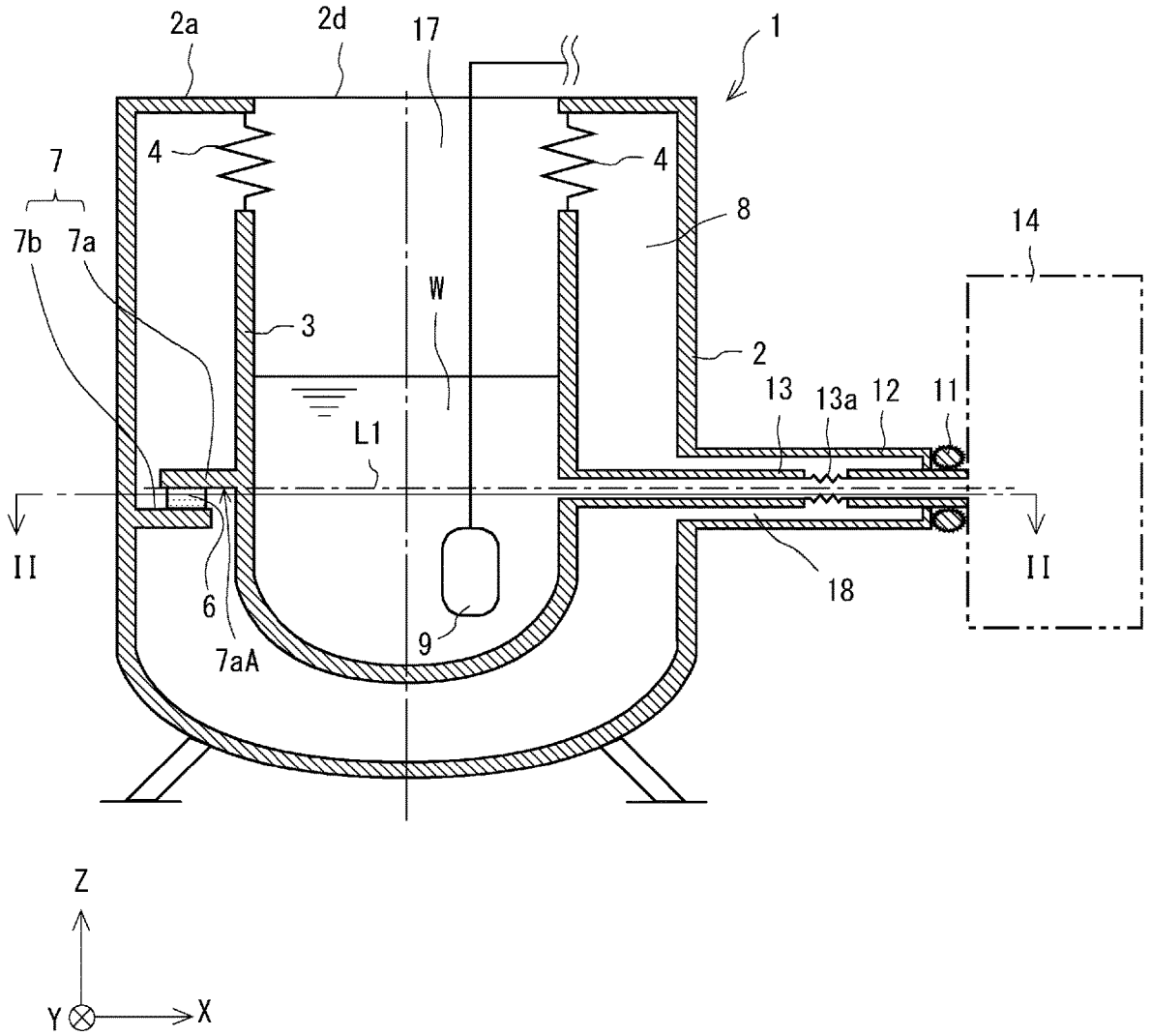
FIG. 1 is a schematic diagram showing a schematic configuration of a molten metal holding container according to a first embodiment.
Figure 2:
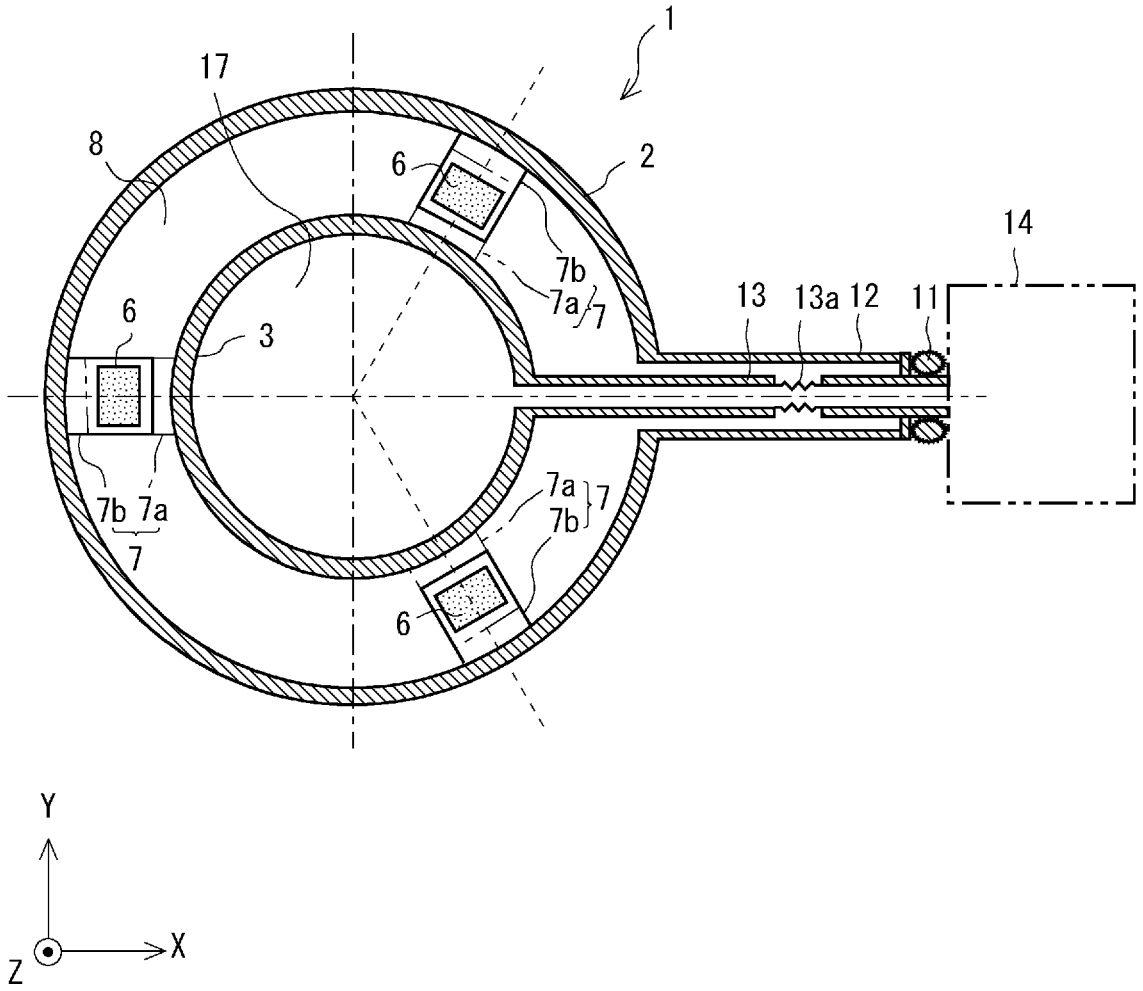
FIG. 2 is a cross section taken along a line II-II in FIG. 1.

FIG. 1 is a schematic diagram showing a schematic configuration of the molten metal holding container 1. FIG. 2 is a cross section taken along a line II-II in FIG. 1. As shown in FIGS. 1 and 2, the molten metal holding container 1 includes an outer pipe 2 serving as an outer wall, an inner pipe 3 serving as an inner wall, a load receiving part 7, an extraction outer pipe 12, and an extraction inner pipe 13.

The outer pipe 2 has a cylindrical shape and has a bottom at the lower end in the vertical direction. Further, an end of the outer pipe 2 opposite to the bottom (i.e., the upper end in the vertical direction) is opened. In the outer pipe 2, an annular wall 2*a* extending inward along (i.e., in parallel with) an opened surface 2*d* is formed. The inner pipe 3 has a cylindrical shape and is coaxially disposed inside the outer pipe 2. Further, the inner pipe 3 has a bottom at the lower end in the vertical direction and its end opposite to the bottom (i.e., the upper end in the vertical direction) is opened. A space inside the inner pipe 3 serves as a containing space 17 for containing molten metal W. The material for the outer and inner pipes 2 and 3 is, for example, stainless steel (SUS304, SUS316L, etc.) or steel. In the containing space 17, the molten metal W is kept at a predetermined temperature by an immersion heater 9.

A bellows 4 is connected to the upper end of the inner pipe 3 in the vertical direction. The other end of the bellows 4, i.e., the end opposite to the end to which the inner pipe 3 is connected is connected to the annular wall 2*a* of the outer pipe 2. That is, the vertically upper ends of the inner and outer pipes 3 and 2 are connected to each other through the bellows 4 and a first sealed space 8 is formed between the outer and inner pipes 2 and 3. Since the bellows 4 is a flexible elastic pipe and acts as an elastic body, it can absorb a deformation of the inner pipe 3 caused by thermal expansion thereof. The material for the bellows 4 is, for example, stainless steel, steel, titanium, or the like. The first sealed space 8 is a depressurized space, that is, a vacuum space. In this way, it is possible to prevent heat from being transferred from the inner pipe 3 to the outer pipe 2.

The extraction outer pipe 12 extends from the outer pipe 2 in the horizontal direction and its internal space is connected to a space inside the outer pipe 2. The extraction inner pipe 13 is disposed inside the extraction outer pipe 12. The extraction inner pipe 13 extends from the inner pipe 3 in the horizontal direction and its internal space is connected to a space inside the inner pipe 3. The extraction inner pipe 13 is provided to extract the molten metal W from the inside of the inner pipe 3, i.e., from the first sealed space 8. A depressurized second sealed space 18 is formed between the extraction outer pipe 12 and the extraction inner pipe 13, and is connected to the first sealed space 8. The molten metal holding container 1 includes a bellows connection part 13*a* in a middle of a part of the extraction inner pipe 13 that is located in the second sealed space 18. An end of the extraction inner pipe 13 opposite to another end at which its internal space is connected to the space inside the inner pipe 3 is connected to a casting machine 14. A heat-insulating material 11 may be disposed in a part of the extraction inner pipe 13 at which the extraction inner pipe 13 is connected to the casting machine 14.

The load receiving part 7 has a first protrusion 7*a* and a second protrusion 7*b*. The vertical position of a vertically lower-side surface 7*a*A of the first protrusion 7*a* supported by the outer pipe 2 through the second protrusion 7*b* coincides with the vertical position of a central axis L1 of the extraction inner pipe 13. The first protrusion 7*a* protrudes from an outer circumference of the inner pipe 3 in the horizontal direction. The second protrusion 7*b* protrudes from an inner circumference of the outer pipe 2 in the horizontal direction so as to be opposed to the first protrusion 7*a* in the vertical direction. Further, the second protrusion 7*b* receives a load of the inner pipe 3 through the first protrusion 7*a*.

Further, an insertion member 6 that is formed of a material having a thermal conductivity lower than that of the outer and inner pipes 2 and 3 is inserted between the first and second protrusions 7*a* and 7*b*. The insertion member 6 is formed of, for example, ceramics. The insertion member 6 may be a laminated structure formed by laminating a plurality of sheet members. When the insertion member 6 is formed as a laminated structure as described above, it can be brought into contact with the first and second protrusions 7*a* and 7*b* more tightly.

Next, states of the molten metal holding container 1 according to this embodiment before and after a high-temperature molten metal W is contained in the containing space 17 are described.

Figure 3:
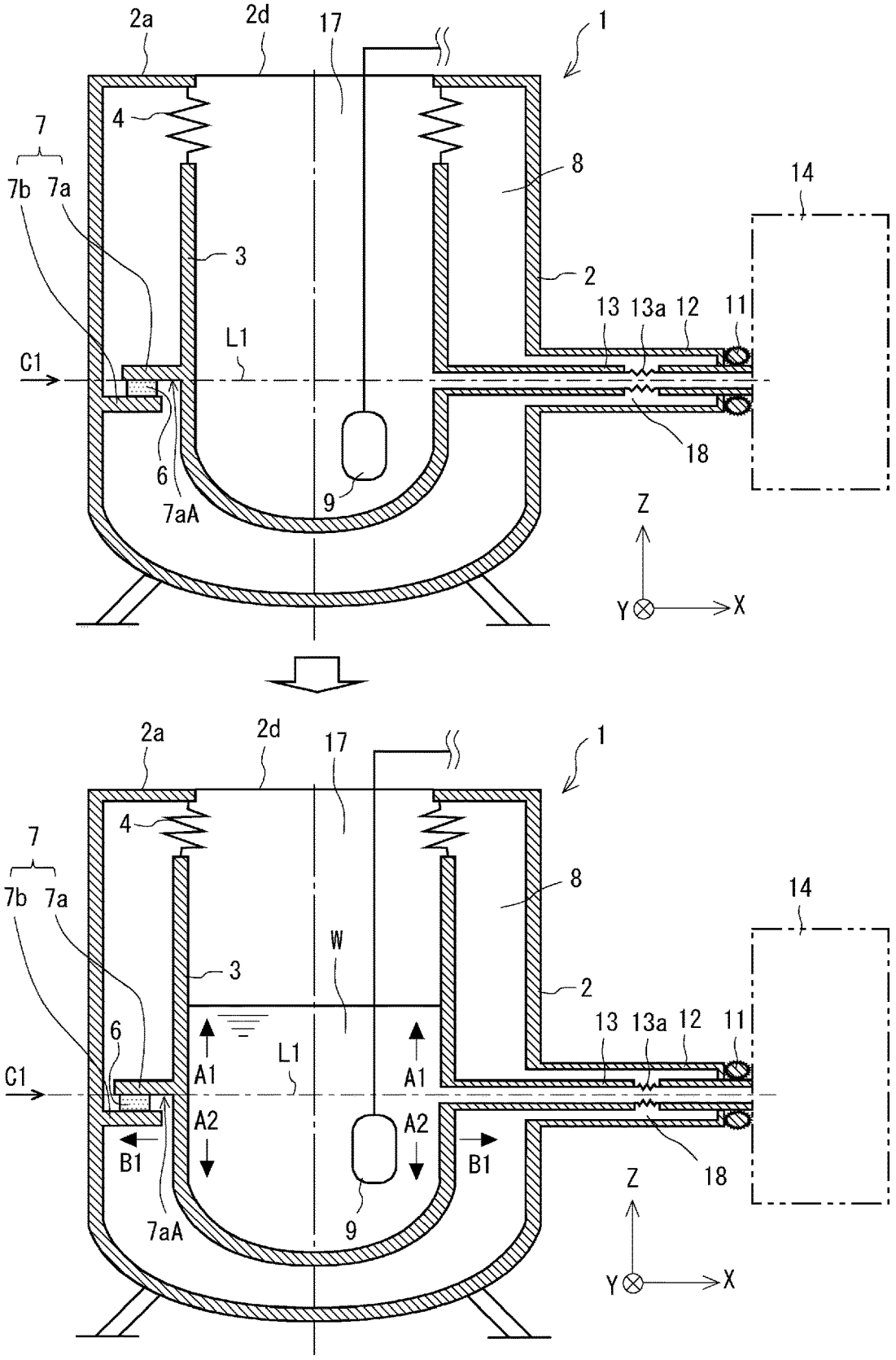
FIG. 3 is a schematic diagram for explaining states before and after a high-temperature molten metal is put into a containing space in the molten metal holding container according to the first embodiment.

FIG. 3 is a schematic diagram for explaining states before and after a high-temperature molten metal W is put into the containing space 17 in the molten metal holding container 1. In FIG. 3, an upper part shows a state of the molten metal holding container 1 before the molten metal W is put into the containing space 17 (a molten metal non-containing state) and a lower part shows a state in which the molten metal W is put into the containing space 17 (a molten metal containing state). Note that when the molten metal W is aluminum, a temperature of the molten metal W is about 800° C.

As shown in FIG. 3, when the high-temperature molten metal W is put into the containing space 17, the inner pipe 3 thermally expands in an axial direction (indicted by arrows A1 and A2) and a radial direction (indicated by an arrow B1). As described above, the second protrusion 7*b* protruding from the inner circumference of the outer pipe 2 in the horizontal direction supports the load of the inner pipe 3 through the first protrusion 7*a* protruding from the outer circumference of the inner pipe 3 in the horizontal direction. When the high-temperature molten metal W is put into the containing space 17, the outer pipe 2 hardly thermally expands. Therefore, the vertical position of the first protrusion 7*a* supported by the second protrusion 7*b* hardly moves and is substantially fixed. Therefore, when the high-temperature molten metal W is put into the containing space 17, the position of the second protrusion 7*b* in the vertical direction becomes the center of the thermal expansion. Further, the part of the inner pipe 3 that is located above the thermal expansion center C1 in the vertical direction thermally expands upward (indicated by the arrow A1) and the part of the inner pipe 3 that is located below the thermal expansion center C1 in the vertical direction thermally expands downward (indicated by the arrow A2).

In the molten metal holding container 1, the vertical position of a vertically lower-side surface 7*a*A of the first protrusion 7*a* supported by the outer pipe 2 through the second protrusion 7*b* coincides with the vertical position of the central axis L1 of the extraction inner pipe 13. As described above, when the high-temperature molten metal W is put in the containing space 17, the vertical position of the first protrusion 7*a* hardly moves and hence the vertical position of the extraction inner pipe 13 also hardly moves. Consequently, it is possible to, when the molten metal W is contained in the molten metal holding container 1, prevent the extraction inner pipe 13 from being broken due to a stress which would otherwise be exerted on the extraction inner pipe 13 because of thermal expansion of the inner pipe 3.

In the molten metal holding container 1, the vertically upper ends of the inner and outer pipes 3 and 2 are connected to each other through the bellows 4. Therefore, when the molten metal W is put into the containing space 17, vertically upward expansion of the part of the inner pipe 3 that is located above the thermal expansion center C1 in the vertical direction is absorbed by the bellows 4 as the bellows 4 contracts. In this way, it is possible to prevent the inner pipe 3 from being warped due to the thermal expansion.

When the molten metal W is put into the containing space 17, the inner pipe 3 thermally expands in the radial direction. As a result, the position of the extraction inner pipe 13 moves in the horizontal direction. In the molten metal holding container 1, since the bellows connection part 13*a* is provided in a middle of the part of the extraction inner pipe 13 located in the second sealed space 18, it is possible to absorb the movement of the position of the extraction inner pipe 13 in the horizontal direction. As a result, it is possible to prevent the extraction inner pipe 13 from being warped due to the thermal expansion of the inner pipe 3.

Second Embodiment

A second embodiment according to the present disclosure is described hereinafter with reference to the drawings. Note that the same symbols as those in the first embodiment are assigned to the same parts as those in the first embodiment, and their descriptions are omitted.

Figure 4:
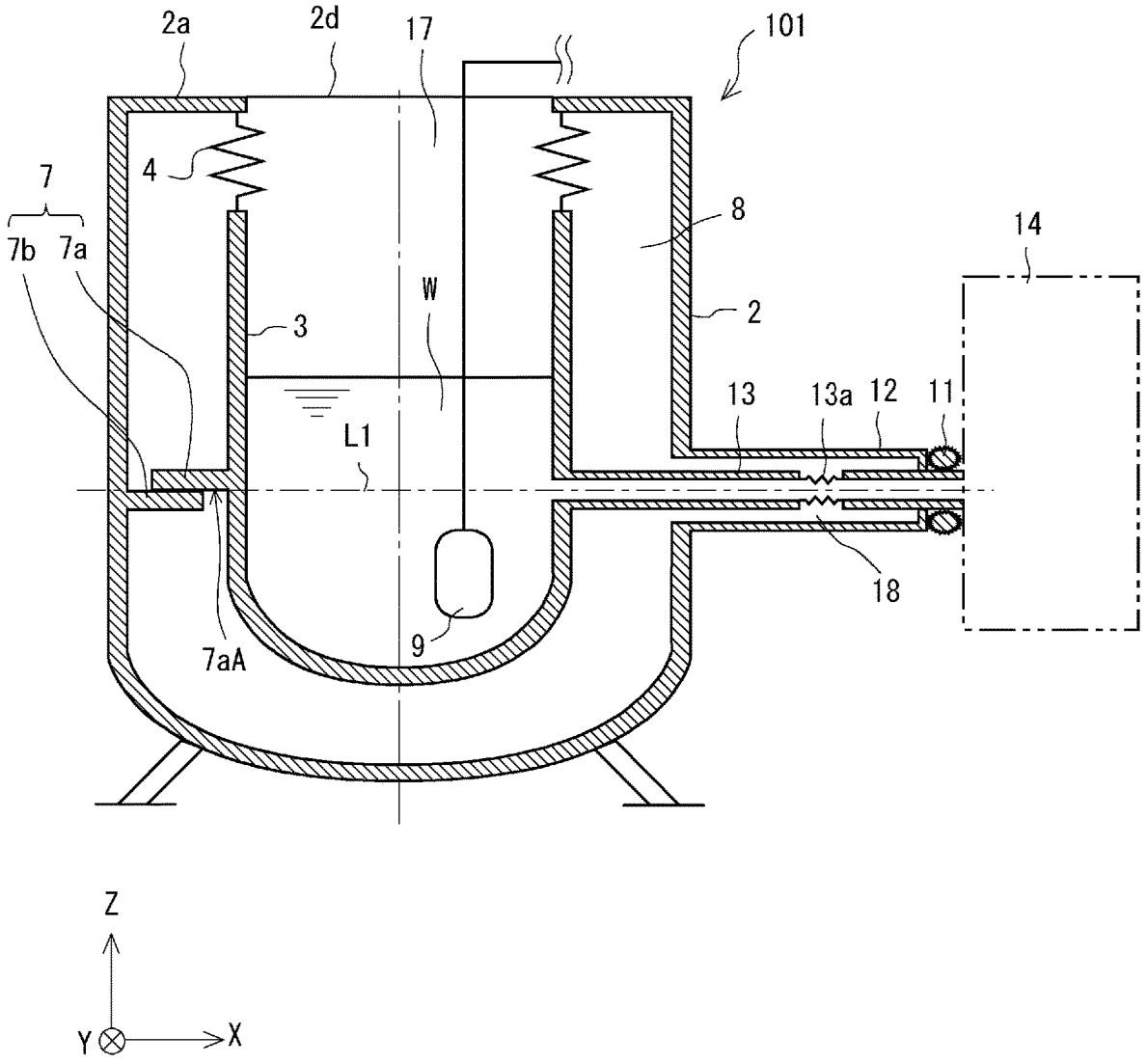
FIG. 4 is a schematic diagram showing a schematic configuration of a molten metal holding container according to a second embodiment.
Figure 5:
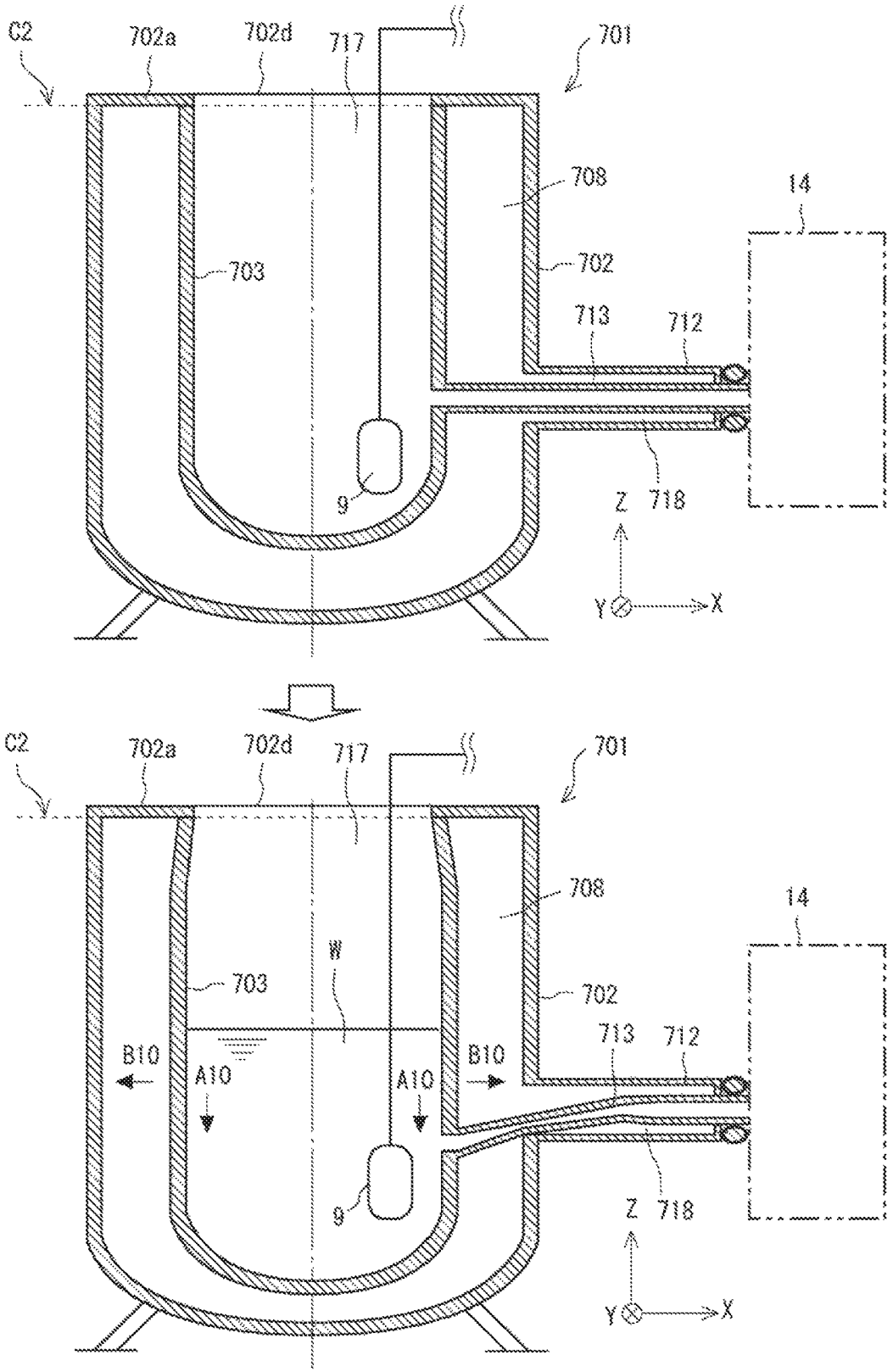
FIG. 5 is a schematic diagram for explaining an example of a molten metal holding container related to a problem to be solved by the present disclosure.

FIG. 4 is a schematic diagram showing a schematic configuration of a molten metal holding container 101 according to a second embodiment. As shown in FIG. 4, the molten metal holding container 101 includes an outer pipe 2, an inner pipe 3, a load receiving part 7, an extraction outer pipe 12, and an extraction inner pipe 13. That is, a configuration of the molten metal holding container 101 is fundamentally the same as that of the molten metal holding container 1 according to the first embodiment (see FIG. 1). The molten metal holding container 101 according to this embodiment differs from the molten metal holding container 1 according to the first embodiment in that the second protrusion 7*b* is directly supported by the first protrusion 7*a* without using any insertion member therebetween in the molten metal holding container 101.

When the second protrusion 7*b* is directly supported by the first protrusion 7*a* as in the case of the molten metal holding container 101 according to this embodiment, the heat-insulating property is somewhat poorer than that of the molten metal holding container 1 according to the first embodiment. However, there is an advantage that the number of components can be reduced.

It should be noted that the present disclosure is not limited to the above-described embodiments and can be modified as appropriate without departing from the scope and spirit of the present disclosure.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A molten metal holding container comprising an outer wall having a bottom at a lower end in a vertical direction, and an inner wall having a bottom at a lower end in the vertical direction, the inner wall being disposed inside the outer wall, in which a depressurized first sealed space is formed between the outer wall and the inner wall, and the molten metal holding container is configured to contain molten metal inside the inner wall, and wherein the molten metal holding container further comprises:

an extraction outer pipe extending from the outer wall in a horizontal direction, a space inside the extraction outer pipe being connected to a space inside the outer wall;

an extraction inner pipe for extracting the molten metal from inside the inner wall, the extraction inner pipe being disposed inside the extraction outer pipe and extending from the inner wall in the horizontal direction, a space inside the extraction inner pipe being connected to a space inside the inner wall; and a load receiving part including a first protrusion protruding from an outer circumference of the inner wall in the horizontal direction and a second protrusion protruding from an inner circumference of the outer wall in the horizontal direction so as to be opposed to the first protrusion in a vertical direction, wherein the first protrusion does not directly contact the outer wall and the second protrusion does not directly contact the inner wall, and the second protrusion being configured to receive a load of the inner wall through the first protrusion, a depressurized second sealed space is formed between the extraction outer pipe and the extraction inner pipe, the second sealed spaced being connected to the first sealed space, and a vertical position of a vertically lower-side surface of the first protrusion supported by the outer wall through the second protrusion coincides with a vertical position of a central axis of the extraction inner pipe.

2. A molten metal holding container comprising an outer wall having a bottom at a lower end in a vertical direction, and an inner wall having a bottom at a lower end in the vertical direction, the inner wall being disposed inside the outer wall, in which a depressurized first sealed space is formed between the outer wall and the inner wall, and the molten metal holding container is configured to contain molten metal inside the inner wall, and wherein the molten metal holding container further comprises:

an extraction outer pipe extending from the outer wall in a horizontal direction, a space inside the extraction outer pipe being connected to a space inside the outer wall;

an extraction inner pipe for extracting the molten metal from inside the inner wall, the extraction inner pipe being disposed inside the extraction outer pipe and extending from the inner wall in the horizontal direction, a space inside the extraction inner pipe being connected to a space inside the inner wall; and a load receiving part including a first protrusion protruding from an outer circumference of the inner wall in the horizontal direction and a second protrusion protruding from an inner circumference of the outer wall in the horizontal direction so as to be opposed to the first protrusion in a vertical direction, the second protrusion being configured to receive a load of the inner wall through the first protrusion, a depressurized second sealed space is formed between the extraction outer pipe and the extraction inner pipe, the second sealed spaced being connected to the first sealed space, and a vertical position of a vertically lower-side surface of the first protrusion supported by the outer wall through the second protrusion coincides with a vertical position of a central axis of the extraction inner pipe, wherein an insertion member formed of a material having a thermal conductivity lower than that of the outer wall and the inner wall is inserted between the first and second protrusions.

3. A molten metal holding container comprising an outer wall having a bottom at a lower end in a vertical direction, and an inner wall having a bottom at a lower end in the vertical direction, the inner wall being disposed inside the outer wall, in which a depressurized first scaled space is formed between the outer wall and the inner wall, and the molten metal holding container is configured to contain molten metal inside the inner wall, and wherein the molten metal holding container further comprises:

an extraction outer pipe extending from the outer wall in a horizontal direction, a space inside the extraction outer pipe being connected to a space inside the outer wall;

an extraction inner pipe for extracting the molten metal from inside the inner wall, the extraction inner pipe being disposed inside the extraction outer pipe and extending from the inner wall in the horizontal direction, a space inside the extraction inner pipe being connected to a space inside the inner wall; and a load receiving part including a first protrusion protruding from an outer circumference of the inner wall in the horizontal direction and a second protrusion protruding from an inner circumference of the outer wall in the horizontal direction so as to be opposed to the first protrusion in a vertical direction, the second protrusion being configured to receive a load of the inner wall through the first protrusion, a depressurized second sealed space is formed between the extraction outer pipe and the extraction inner pipe, the second sealed spaced being connected to the first sealed space, and a vertical position of a vertically lower-side surface of the first protrusion supported by the outer wall through the second protrusion coincides with a vertical position of a central axis of the extraction inner pipe, wherein an upper end of the outer wall in the vertical direction and an upper end of the inner wall in the vertical direction are connected to each other through a bellows.

4. A molten metal holding container comprising an outer wall having a bottom at a lower end in a vertical direction, and an inner wall having a bottom at a lower end in the vertical direction, the inner wall being disposed inside the outer wall, in which a depressurized first sealed space is formed between the outer wall and the inner wall, and the molten metal holding container is configured to contain molten metal inside the inner wall, and wherein the molten metal holding container further comprises:

an extraction outer pipe extending from the outer wall in a horizontal direction, a space inside the extraction outer pipe being connected to a space inside the outer wall;

an extraction inner pipe for extracting the molten metal from inside the inner wall, the extraction inner pipe being disposed inside the extraction outer pipe and extending from the inner wall in the horizontal direction, a space inside the extraction inner pipe being connected to a space inside the inner wall; and a load receiving part including a first protrusion protruding from an outer circumference of the inner wall in the horizontal direction and a second protrusion protruding from an inner circumference of the outer wall in the horizontal direction so as to be opposed to the first protrusion in a vertical direction, the second protrusion being configured to receive a load of the inner wall through the first protrusion, a depressurized second sealed space is formed between the extraction outer pipe and the extraction inner pipe, the second sealed spaced being connected to the first sealed space, and a vertical position of a vertically lower-side surface of the first protrusion supported by the outer wall through the second protrusion coincides with a vertical position of a central axis of the extraction inner pipe, further comprising a bellows connection part in a middle of a part of the extraction inner pipe that is located in the second sealed space.

* * * * *